US008823285B2

(12) United States Patent
Chobot

(10) Patent No.: US 8,823,285 B2
(45) Date of Patent: Sep. 2, 2014

(54) LIGHTING DEVICES INCLUDING BOOST CONVERTERS TO CONTROL CHROMATICITY AND/OR BRIGHTNESS AND RELATED METHODS

(75) Inventor: Joseph P. Chobot, Morrisville, NC (US)

(73) Assignee: Cree, Inc., Durham, NC (US)

( * ) Notice: Subject to any disclaimer, the term of this patent is extended or adjusted under 35 U.S.C. 154(b) by 162 days.

(21) Appl. No.: 13/370,776

(22) Filed: Feb. 10, 2012

(65) Prior Publication Data

US 2013/0147380 A1 Jun. 13, 2013

Related U.S. Application Data

(63) Continuation-in-part of application No. 13/323,074, filed on Dec. 12, 2011.

(60) Provisional application No. 61/569,458, filed on Dec. 12, 2011.

(51) Int. Cl.
*H05B 37/02* (2006.01)

(52) U.S. Cl.
USPC ..... 315/307; 315/210; 315/250

(58) Field of Classification Search
USPC ..... 315/210, 224–226, 247, 250, 291, 299, 315/306–308, 312, 360
See application file for complete search history.

(56) References Cited

U.S. PATENT DOCUMENTS

| | | | |
|---|---|---|---|
| 3,638,042 | A | 1/1972 | Studtmann |
| 3,655,988 | A | 4/1972 | Nakamura et al. |
| 3,913,098 | A | 10/1975 | Nakamura et al. |
| 5,059,788 | A | 10/1991 | Tashiro et al. |
| 5,125,675 | A | 6/1992 | Engelbrecht |
| 5,357,120 | A | 10/1994 | Mori |
| 5,467,049 | A | 11/1995 | Kida et al. |
| 5,598,068 | A | 1/1997 | Shirai |

(Continued)

FOREIGN PATENT DOCUMENTS

| | | |
|---|---|---|
| EP | 1 020 935 A2 | 7/2000 |
| EP | 1 594 348 | 11/2005 |

(Continued)

OTHER PUBLICATIONS

International Preliminary Report on Patentability Corresponding to International Application No. PCT/US2011/054846; Date of Mailing: May 16, 2013; 10 Pages.

(Continued)

*Primary Examiner* — Tung X Le
(74) *Attorney, Agent, or Firm* — Myers Bigel Sibley & Sajovec, P.A.

(57) ABSTRACT

A solid state lighting device may include a power supply, a light emitting device, and a boost converter. The boost converter may have an input node electrically coupled to the power supply and an output node with the light emitting device electrically coupled between the output node and a reference node. The boost converter may include a switch electrically coupled in a current shunting path between the input node and the reference node, and a controller. The switch may be configured to shunt current from the power supply around the light emitting device. The controller may be configured to generate a pulse width modulation (PWM) signal to control a duty cycle of the switch to provide a pulse width modulated electrical current through the switch and a continuous electrical current through the light emitting device. Related methods are also discussed.

33 Claims, 4 Drawing Sheets

(56) References Cited

U.S. PATENT DOCUMENTS

| | | | | |
|---|---|---|---|---|
| 5,646,760 | A | 7/1997 | Kuijk et al. | |
| 5,798,520 | A | 8/1998 | Kuijk et al. | |
| 6,396,718 | B1 | 5/2002 | Ng et al. | |
| 6,411,155 | B2 | 6/2002 | Pezzani | |
| 6,501,630 | B1 | 12/2002 | Colclaser et al. | |
| 6,784,622 | B2 | 8/2004 | Newman, Jr. et al. | |
| 7,109,664 | B2 | 9/2006 | Wu | |
| 7,213,940 | B1 | 5/2007 | Van De Ven et al. | |
| 7,307,391 | B2 | 12/2007 | Shan | |
| 7,427,838 | B2 | 9/2008 | Hosoya | |
| 7,439,945 | B1 | 10/2008 | Awalt et al. | |
| 7,550,934 | B1 * | 6/2009 | Deng et al. | 315/308 |
| 7,821,194 | B2 | 10/2010 | Negley et al. | |
| 7,967,652 | B2 | 6/2011 | Emerson | |
| 8,148,911 | B2 * | 4/2012 | Chen et al. | 315/250 |
| 8,188,682 | B2 * | 5/2012 | Nalbant | 315/306 |
| 8,294,388 | B2 * | 10/2012 | Wong et al. | 315/307 |
| 8,525,774 | B2 | 9/2013 | Lin et al. | |
| 8,618,748 | B2 * | 12/2013 | Shiu et al. | 315/307 |
| 2001/0032985 | A1 | 10/2001 | Bhat et al. | |
| 2002/0043943 | A1 | 4/2002 | Menzer et al. | |
| 2002/0139987 | A1 | 10/2002 | Collins, III et al. | |
| 2004/0042205 | A1 | 3/2004 | Tanabe et al. | |
| 2004/0183380 | A1 | 9/2004 | Otake | |
| 2005/0179629 | A1 | 8/2005 | Inoue | |
| 2006/0049782 | A1 | 3/2006 | Vornsand et al. | |
| 2006/0176411 | A1 | 8/2006 | Furukawa | |
| 2006/0221609 | A1 | 10/2006 | Ryan | |
| 2006/0244396 | A1 | 11/2006 | Bucur | |
| 2007/0013620 | A1 | 1/2007 | Tanahashi et al. | |
| 2007/0108843 | A1 | 5/2007 | Preston et al. | |
| 2007/0115228 | A1 | 5/2007 | Roberts et al. | |
| 2007/0115662 | A1 | 5/2007 | Roberts et al. | |
| 2007/0195023 | A1 | 8/2007 | Kang et al. | |
| 2008/0018261 | A1 * | 1/2008 | Kastner | 315/192 |
| 2008/0024071 | A1 | 1/2008 | Yu | |
| 2008/0122376 | A1 | 5/2008 | Lys | |
| 2008/0130283 | A1 | 6/2008 | Chang | |
| 2008/0150440 | A1 | 6/2008 | Hsu | |
| 2008/0211415 | A1 | 9/2008 | Altamura | |
| 2008/0252197 | A1 | 10/2008 | Li et al. | |
| 2009/0039791 | A1 | 2/2009 | Jones | |
| 2009/0140630 | A1 | 6/2009 | Kijima et al. | |
| 2009/0160363 | A1 | 6/2009 | Negley et al. | |
| 2009/0184616 | A1 | 7/2009 | Van De Ven et al. | |
| 2010/0060175 | A1 | 3/2010 | Lethellier | |
| 2010/0109537 | A1 | 5/2010 | Nishino et al. | |
| 2010/0109570 | A1 | 5/2010 | Weaver | |
| 2010/0225251 | A1 | 9/2010 | Maruyama | |
| 2010/0259182 | A1 | 10/2010 | Man et al. | |
| 2010/0308738 | A1 | 12/2010 | Shteynberg et al. | |
| 2010/0308739 | A1 | 12/2010 | Shteynberg et al. | |
| 2011/0068696 | A1 | 3/2011 | van de Ven et al. | |
| 2011/0068702 | A1 | 3/2011 | Van De Ven et al. | |
| 2011/0074292 | A1 | 3/2011 | Maehara | |
| 2011/0148314 | A1 | 6/2011 | Lin et al. | |
| 2011/0309760 | A1 * | 12/2011 | Beland et al. | 315/201 |
| 2012/0313545 | A1 * | 12/2012 | Courtel | 315/250 |

FOREIGN PATENT DOCUMENTS

| | | | |
|---|---|---|---|
| JP | 59-113768 | A | 6/1984 |
| JP | 4 196359 | A | 7/1992 |
| WO | WO 2007/023454 | | 3/2007 |

OTHER PUBLICATIONS

International Search Report Corresponding to International Application No. PCT/US2012/069085; Date of Mailing: Feb. 20, 2013; 14 Pages.

International Search Report Corresponding to International Application No. PCT/US12/69079; Date of Mailing: Feb. 28, 2013; 20 Pages.

International Search Report Corresponding to International Application No. PCT/US11/54846; Date of Mailing: Jan. 23, 2012; 13 pages.

Notification of Transmittal of the International Search Report and the Written Opinion of the International Searching Authority, or the Declaration, International Search Report, and Written Opinion of the International Searching Authority, PCT International Application No. PCT/US2006/011820, Aug. 7, 2006.

Chobot, Joseph Paul, U.S. Appl. No. 12/987,485, "Systems and Methods for Controlling Solid State Lighting Devices and Lighting Apparatus Incorporating Such Systems and/or Methods", filed Jan. 10, 2011.

Chinese Office Action (33 pages) corresponding to Chinese Patent Application No. 201080053242; Issue Date: Nov. 27, 2013.

Extended Search Report Corresponding to International Application No. PCT/US2011054846; Date of Mailing: Feb. 17, 2014; 7 Pages.

Extended Search Report Corresponding to International Application No. PCT/US2010048567; Date of Mailing: Mar. 14, 2014; 8 Pages.

* cited by examiner

LIGHTING DEVICES INCLUDING BOOST CONVERTERS TO CONTROL CHROMATICITY AND/OR BRIGHTNESS AND RELATED METHODS

RELATED APPLICATIONS

The present application claims the benefit of priority as a continuation-in-part (CIP) of U.S. Utility application Ser. No. 13/323,074 filed Dec. 12, 2011. The present application also claims the benefit of priority of U.S. Provisional Application Ser. No. 61/569,458 filed Dec. 12, 2011. The disclosures of both of the above referenced applications are hereby incorporated herein in their entireties by reference.

FIELD OF THE INVENTION

The present invention relates to lighting, and more particularly to solid state lighting.

BACKGROUND

Solid state lighting devices are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) screens, such as LCD display screens used in portable electronic devices. In addition, there has been increased interest in the use of solid state lighting panels as backlights for larger displays, such as LCD television displays.

For smaller LCD screens, backlight assemblies typically employ white LED lighting devices that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

Visible light may include light having many different wavelengths. The apparent color of visible light can be illustrated with reference to a two dimensional chromaticity diagram, such as the 1931 International Conference on Illumination (CIE) Chromaticity Diagram illustrated in FIG. 5, and the 1976 CIE u'v' Chromaticity Diagram, which is similar to the 1931 Diagram but is modified such that similar distances on the 1976 u'v' CIE Chromaticity Diagram represent similar perceived differences in color. These diagrams provide useful reference for defining colors as weighted sums of colors.

In a CIE-u'v' chromaticity diagram, such as the 1976 CIE Chromaticity Diagram, chromaticity values are plotted using scaled u' and v' parameters which take into account differences in human visual perception. That is, the human visual system is more responsive to certain wavelengths than others. For example, the human visual system is more responsive to green light than red light. The 1976 CIE-u'v' Chromaticity Diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, such as the 1931 CIE Chromaticity Diagram, two colors that are not distinguishably different may be located farther apart on the graph than two colors that are distinguishably different.

As shown in FIG. 5, colors on a 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 5. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 5 generally appears magenta (i.e., red-purple or purplish red).

It is further known that a binary combination of light from two different light sources may appear to have a different color than either of the two constituent colors. The color of the combined light may depend on the relative intensities of the two light sources. For example, light emitted by a combination of a blue source and a red source may appear purple or magenta to an observer. Similarly, light emitted by a combination of a blue source and a yellow source may appear white to an observer.

Also illustrated in FIG. 5 is the planckian locus 106, which corresponds to the location of color points of light emitted by a black-body radiator that is heated to various temperatures. In particular, FIG. 5 includes temperature listings along the black-body locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature. Illuminants which produce light which is on or near the black-body locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the planckian locus. Accordingly, a white point may be identified by a correlated color temperature (CCT) of the light source. White light typically has a CCT of between about 2000 K and 8000 K. White light with a CCT of 4000 may appear yellowish in color, while light with a CCT of 8000 K may appear more bluish in color. Color coordinates that lie on or near the black-body locus at a color temperature between about 2500 K and 6000 K may yield pleasing white light to a human observer.

"White" light also includes light that is near, but not directly on the planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the planckian locus may be considered to have the same color as the point on the planckian locus.

The ability of a light source to accurately reproduce color in illuminated objects is typically characterized using the color rendering index (CRI). In particular, CRI is a relative measurement of how the color rendering properties of an illumination system compare to those of a black-body radiator. The CRI equals 100 if the color coordinates of a set of test colors being illuminated by the illumination system are the same as the coordinates of the same test colors being irradiated by the black-body radiator. Daylight has the highest CRI (of 100), with incandescent bulbs being relatively close (about 95), and fluorescent lighting being less accurate (70-85).

For large-scale backlight and illumination applications, it is often desirable to provide a lighting source that generates a white light having a high color rendering index, so that objects and/or display screens illuminated by the lighting panel may appear more natural. Accordingly, to improve CRI, red light may be added to the white light, for example, by adding red emitting phosphor and/or red emitting devices to the apparatus. Other lighting sources may include red, green and blue light emitting devices. When red, green and blue light emitting devices are energized simultaneously, the resulting combined light may appear white, or nearly white, depending on the relative intensities of the red, green and blue sources.

One difficulty with solid state lighting systems including multiple solid state devices is that the manufacturing process for LEDs typically results in variations between individual LEDs. This variation is typically accounted for by binning, or grouping, the LEDs based on brightness, and/or color point, and selecting only LEDs having predetermined characteristics for inclusion in a solid state lighting system. LED lighting devices may utilize one bin of LEDs, or combine matched sets of LEDs from different bins, to achieve repeatable color points for the combined output of the LEDs. Even with binning, however, LED lighting systems may still experience significant variation in color point from one system to the next.

One technique to tune the color point of a lighting fixture, and thereby utilize a wider variety of LED bins, is described in commonly assigned United States Patent Publication No. 2009/0160363, the disclosure of which is incorporated herein by reference. The '363 application describes a system in which phosphor converted LEDs and red LEDs are combined to provide white light. The ratio of the various mixed colors of the LEDs is set at the time of manufacture by measuring the output of the light and then adjusting string currents to reach a desired color point. The current levels that achieve the desired color point are then fixed for the particular lighting device. LED lighting systems employing feedback to obtain a desired color point are described in U.S. Publication Nos. 2007/0115662 and 2007/0115228, the disclosures of which are incorporated herein by reference.

SUMMARY

According to some embodiments of the present invention, a solid state lighting device may include a power supply, a light emitting device (e.g., a light emitting diode), and a boost converter. The boost converter may have an input node electrically coupled to the power supply and an output node with the light emitting device electrically coupled between the output node and a reference node. The boost converter may further include a switch and a controller. The switch may be electrically coupled in a current shunting path between the input node and the reference node, and the switch may be configured to shunt current from the power supply around the light emitting device. The controller may be configured to generate a pulse width modulation (PWM) signal to control a duty cycle of the switch to provide a pulse width modulated electrical current through the switch and a continuous electrical current through the light emitting device. While one shunted light emitting device is discussed by way of example, any number of serially coupled light emitting devices (e.g., light emitting diodes) may be provided between the output node and the reference node. A continuous electrical current through the light emitting device(s) and a constant voltage of the input node may thus be inversely related (e.g., inversely proportional) to the duty cycle of the current through the switch when operating in a steady state condition.

The switch may be electrically coupled in the current shunting path between a switch node and the reference node, an inductor may be electrically coupled between the input node and the switch node, and a diode (e.g., a regular non-light-emitting diode) may be electrically coupled between the switch node and the output node. In addition, a capacitor may be electrically coupled between a capacitor node at an output of the diode and the reference node, and a second inductor may be electrically coupled between the capacitor node and the output node. The boost converter may be configured to provide a constant voltage at the input node corresponding to the continuous current through the light emitting device.

The power supply may be a current controlled power supply. Moreover, providing the pulse width modulated electrical current through the switch may include providing a first pulse width modulated electrical current having a first duty cycle to provide a first continuous current through the light emitting device and a first constant voltage at the input node in a first steady state condition and providing a second pulse width modulated electrical current having a second duty cycle to provide a second continuous current through the light emitting device and a second constant voltage at the input node in a second steady state condition. More particularly, the first duty cycle may be greater than the second duty cycle, the first continuous current may be less than the second continuous current, and the first constant voltage may be less than the second constant voltage. Different duty cycles can thus be used to maintain a desired color output in different operating conditions (e.g., in different temperature conditions), and/or to adjust lumen/brightness output (e.g., dimmer control).

The light emitting device may be a first light emitting device, and the reference node may be a first reference node. In addition, a second light emitting device may be electrically coupled between the input node and the power supply and/or between the first reference node and a second reference node. While one non-shunted light emitting device is discussed by way of example, any number of non-shunted light emitting devices may be provided.

According to some other embodiments of the present invention, a solid state lighting device may include a power supply, a light emitting device (e.g., a light emitting diode), and a boost converter. The boost converter may have an input node electrically coupled to the power supply and an output node with the light emitting device electrically coupled between the output node and a reference node. In addition, the boost converter may include a switch, a diode, and a controller. The switch may be electrically coupled in a current shunting path between the input node and the reference node, and the diode may be electrically coupled between the input node and the output node so that the diode is electrically coupled between the switch and the output node. The controller may be electrically coupled to a control electrode of the switch, with the controller being configured to generate a pulse width modulation (PWM) signal to control a duty cycle of a pulse width modulated shunt current through the switch from the power supply away from the light emitting device. While a single shunted light emitting device is discussed by way of example, any number of serially coupled shunted light emitting devices may be provided between the output and reference nodes.

The switch may be electrically coupled to a switch node between the input node and the diode, and an inductor may be electrically coupled between the input node and a switch node. A capacitor node may be defined between the diode and the output node, and a capacitor may be electrically coupled between the capacitor node and the reference node. The inductor may be a first inductor, and a second inductor may be electrically coupled between the capacitor node and the output node.

The light emitting device may include a first light emitting device, the reference node may be a first reference node, and a second light emitting device may be electrically coupled between the input node and the power supply and/or between the first reference node and a second reference node. While one non-shunted light emitting device is discussed by way of example, any number of non-shunted light emitting devices may be provided. The boost converter may be configured to provide a constant voltage at the input node corresponding to a continuous current provided through the light emitting device responsive to the pulse width modulated shunt current when operating in a steady state condition.

The power supply may be a current controlled power supply. Moreover, the controller may be configured to provide a first pulse width modulated shunt current having a first duty cycle to provide a first continuous current through the light emitting device and a first constant voltage at the input node in a first steady state condition and to provide a second pulse width modulated shunt current having a second duty cycle to provide a second continuous current through the light emitting device and a second constant voltage at the input node in a second steady state condition. More particularly, the first duty cycle may be greater than the second duty cycle, the first continuous current may be less than the second continuous current, and the first constant voltage may be less than the second constant voltage. The controller may thus be configured to provide different shunt current duty cycles at different operating conditions (e.g., at different operating temperatures) to maintain a desired current balance, and/or to provide different shunt current duty cycles responsive to different dimmer inputs to control lumen output (e.g., to provide brightness or dimming control). The boost converter may thus be configured so that a voltage at the input node and an electrical current though the light emitting device are inversely related (e.g., inversely proportional) to the duty cycle of the switch and the duty cycle of the shunt current through the switch.

According to still other embodiments of the present invention, a solid state lighting device may include a power supply, a light emitting device (e.g., a light emitting diode), and a boost converter. The boost converter may have an input node electrically coupled to the power supply and an output node with the light emitting device electrically coupled between the output node and a reference node. The boost converter may be further configured to provide a continuous electrical current through the light emitting device and a constant voltage at the input node responsive to a pulse width modulated shunt current around the light emitting device. While one light emitting device is discussed by way of example, any number of shunted light emitting devices may be electrically coupled in series between the output node and the reference node.

The power supply may be a current controlled power supply. Moreover, the boost converter may include a switch and a controller. The switch may be electrically coupled in a current shunting path between the input node and the reference node, with the switch being configured to modulate the pulse width modulated shunt current through the current shunting path around the light emitting device. The controller may be configured to generate a pulse width modulation (PWM) signal to control a duty cycle of the switch and a duty cycle of the pulse width modulated shunt current.

The switch may be electrically coupled in the current shunting path between a switch node and the reference node, an inductor may be electrically coupled between the input node and the switch node, and a diode may be electrically coupled between the switch node and the output node. A capacitor may be electrically coupled between a capacitor node at an output of the diode and the reference node, and a second inductor may be electrically coupled between the capacitor node and the output node.

The light emitting device may be a first light emitting device, the reference node may be a first reference node, and a second light emitting device may be electrically coupled between the input node and the power supply, and/or between the first reference node and a second reference node. While one non-shunted light emitting device is discussed by way of example, any number of non-shunted light emitting devices may be provided.

In a first steady state condition, the continuous electrical current may be a first continuous electrical current, the constant voltage may be a first constant voltage, and the pulse width modulated shunt current may be a first pulse width modulated shunt current having a first duty cycle. In a second steady state condition, the boost converter may be configured to provide a second continuous electrical current through the light emitting device and a second constant voltage at the input node responsive to a second pulse width modulated shunt current having a second duty cycle. More particularly, the second continuous electrical current may be greater than the first continuous electrical current, the second constant voltage may be greater than the first constant voltage, and the second duty cycle may be less than the first duty cycle.

The voltage at the input node and the current through the shunted light emitting device may thus be inversely related (e.g., inversely proportional) to a duty cycle of the shunt current. The controller may thus be configured to provide different shunt currents at different operating conditions (e.g., at different operating temperatures) to maintain a desired current balance, and/or to provide different shunt currents responsive to different dimmer inputs to control lumen output (e.g., to control brightness or dimming control).

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

In a solid-state lighting device, electric current is driven through an arrangement of Light Emitting Devices LEDs (e.g., light emitting diodes) to provide a light output. Moreover, current through LEDs of different colors may be adjusted to provide a balance of colors so that a combined/mixed output of the LEDs may appear white. Co-pending and commonly assigned U.S. patent application Ser. No. 12/987,485 (filed Jan. 10, 2011, and entitled "Systems And Methods For Controlling Solid State Lighting Devices And Lighting Apparatus Incorporating Such Systems And/Or Methods") discloses systems and methods to control and/or balance outputs of LEDs to provide a desired output. The disclosure of U.S. application Ser. No. 12/987,485 is hereby incorporated herein in its entirety by reference.

Figure 1:
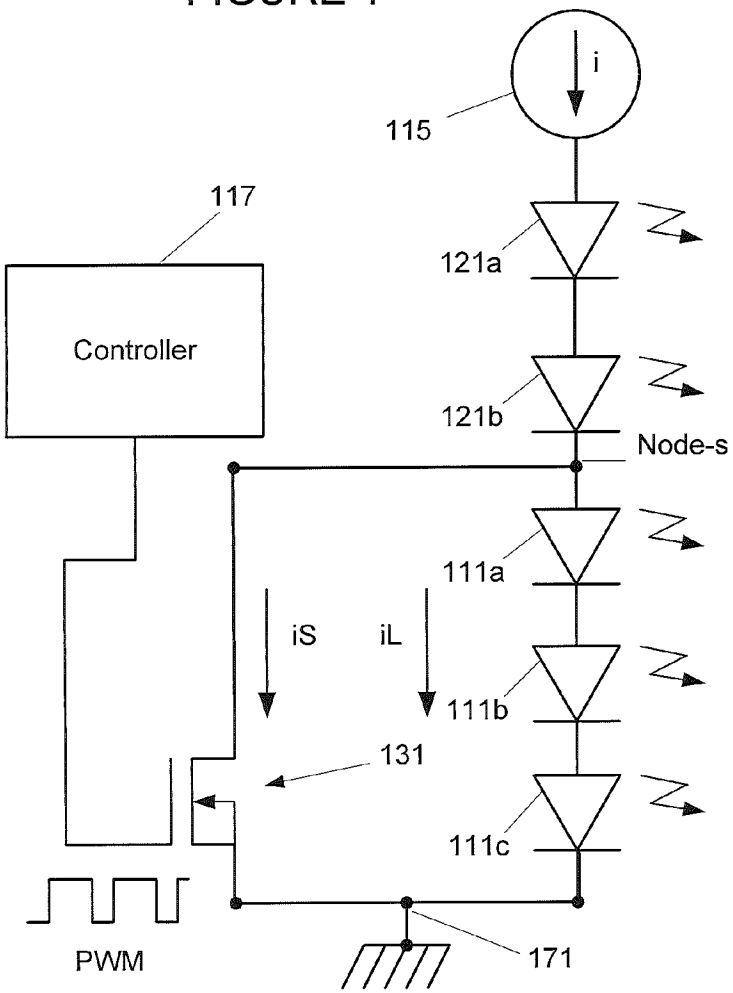

As shown in FIG. 1, a string of LEDs (e.g., light emitting diodes) 111*a-c* and 121*a-b* may be electrically coupled in series between current controlled power supply 115 and reference node 171 (e.g., ground node). Moreover, LEDs 121*a-b* may generate light of a first color (e.g., blue shifted yellow or BSY), and LEDs 111*a-c* may generate light of a second color (e.g., red) to provide a combined/mixed output that is perceived as being white. Moreover, current controlled power supply 115 may be modeled as an ideal current source to provide a relatively constant current i through LEDs 121*a-b*. Because performances of different LEDs of different colors may vary over temperature and/or time and/or because different LEDs of the same color may have different operating characteristics (e.g., due to manufacturing differences/tolerances), a constant current through all of LEDs 111*a-c* and 121*a-b* may not provide sufficient control of a resulting combined light output. LEDs 111*a-c* and 121*a-b* may thus be electrically coupled in series between current controlled power supply 115 and a reference node such as ground voltage node 171, with switch 131 providing a bypass to shunt current around LEDs 111*a-c*. Accordingly, a current iL through LEDs 111*a-c* may be reduced relative to a current i through LEDs 121*a-b* by providing a pulse width modulated (PWM) bypass or shunt current iS through switch 131.

A desired balance of BSY light output (from LEDs 121*a-b*) and red light output (from LEDs 111*a-c*), for example, may be provided by controlling a shunting current through switch 131 around LEDs 111*a-c*. Switch 131, for example, may be a transistor (e.g., a field effect transistor or FET) having a control electrode (e.g., a gate electrode) electrically coupled to controller 117, and controller 117 may generate a pulse width modulation (PWM) signal that is applied to the control electrode of switch 131 to control a duty cycle of switch 131.

A shunt current iS may thus be diverted from LEDs 111*a-c* through switch 131 to reference node 171 (e.g., ground voltage node) to control a current iL through LEDs 111*a-c* relative to a current i from current controlled power supply 115 that is provided through LEDs 121*a-b*. The relatively constant current i generated by current controlled power supply 115 is thus equal to the sum of the currents iL and iS, and the currents iL and iS may be varied by varying a duty cycle of switch 131. By increasing a duty cycle of switch 131 (so that switch 131 remains on for a longer period of time), an average of current iS increases and an average of current iL decreases thereby decreasing a light output of LEDs 111*a-c* (and decreasing a power consumed by LEDs 111*a-c*) due to the reduced current iL therethrough. By reducing a duty cycle of switch 131 (so that switch 131 remains off for a longer period of time), an average of current iS decreases and an average of current iL increases thereby increasing a light output of LEDs 111*a-c* (and increasing a power consumed by LEDs 111*a-c*) due to the increased current iL therethrough. At 100% duty cycle (i.e., duty cycle or D equal to 1) for switch 131, iS=i, and iL=0 so that LEDs 111*a-c* provide no light output and consume no power. At 0% duty cycle (i.e., duty cycle or D equal to 0) for switch 131, iS=0 and iL=i so that LEDs 111*a-c* provide full light output and consume power that may be calculated as a product of the current i and a voltage drop across LEDs 111*a-c*. Of course, a duty cycle of switch 131 may be varied between 0% and 100% (between 0 and 1) to vary a light output of LEDs 111*a-c* (and a power consumed thereby) while maintaining a relatively steady light output from LEDs 121*a-b*.

However, the switch 131 may not provide adequate control and/or reliability because capacitances (e.g., resulting from LEDs 121*a-b* and/or 111*a-c*) inherent in the device of FIG. 1 may cause sudden changes in voltages along the string of LEDs that may produce significant current spikes through LEDs 121*a-b*. These problems may be magnified with increasing numbers of LEDs 111 coupled in parallel with switch 131 and/or with power supplies having large output capacitances. Stated in other words, a voltage at node-s may transition responsive to each transition of switch 131 between a voltage equal to a sum of the forward voltage drop of LEDs 111*a-c* (when switch 131 is off) and the ground voltage (when switch 131 is on). Moreover, these voltage transitions may occur at the frequency of the pulse width modulation signal applied to switch 131, and these high frequency voltage transitions may cause high frequency current spikes.

Figure 2:
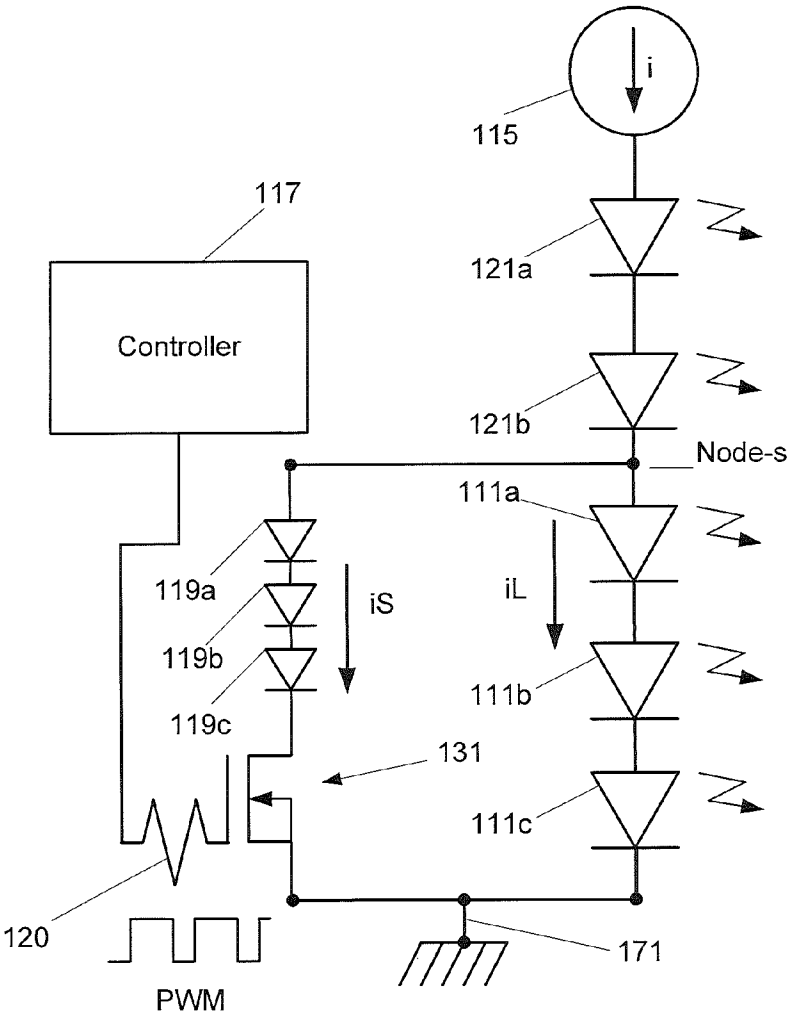
FIGS. 1, 2, 3, and 4 are schematic circuit diagrams of solid state lighting devices according to some embodiments of the present invention.

As shown in FIG. 2, regular diodes 119*a-c* (e.g., non-light emitting diodes, also referred to as dark emitting diodes) may be provided in series with switch 131 to reduce changes in voltages experienced by LEDs 121*a-b* when switch 131 is turned on and off. By reducing changes in voltages during switching, a severity of current spikes may be reduced. A perfect matching of voltages may be undesirable, however, because the resulting shunt current iS may not sufficiently reduce the current iL when the switch 131 is turned on. To provide a desired shunting current iS when switch 131 is on, a voltage drop across diodes 119*a-c* may be designed to be less than a voltage drop across shunted LEDs 111*a-c* to provide a desired shunt current iS when switch 131 is turned on. In addition or in an alternative, a resistor 120 may be provided between a control electrode of switch 131 and controller 117 to reduce a slope of transitions between on and off for switch 131 thereby reducing changes in voltages and/or current spikes.

To maintain more stable currents and/or voltages when switch 131 is turned on and off, a total power dissipation resulting from the sum of currents iS and iL may need to remain unchanged. Accordingly, any current iS shunted through switch 131 in the structure of FIG. 2 may need to contribute to a desired total constant power resulting from the sum of currents iS and iL, and any power consumed by shunt current iS may be dissipated/wasted as heat.

Controller 117 of FIGS. 1 and 2, for example, may generate a PWM control signal having any frequency greater than a flicker fusion threshold. Moreover, a relatively low frequency may be used to reduce a frequency of voltage transitions at node-s and/or current spikes through LEDs 121*a-b*, and/or to reduce electromagnetic interference (EMI) generated the lighting device. According to some embodiments, controller 117 of FIGS. 1 and 2 may generate a PWM control signal having a frequency of about 500 Hz.

Figure 3:
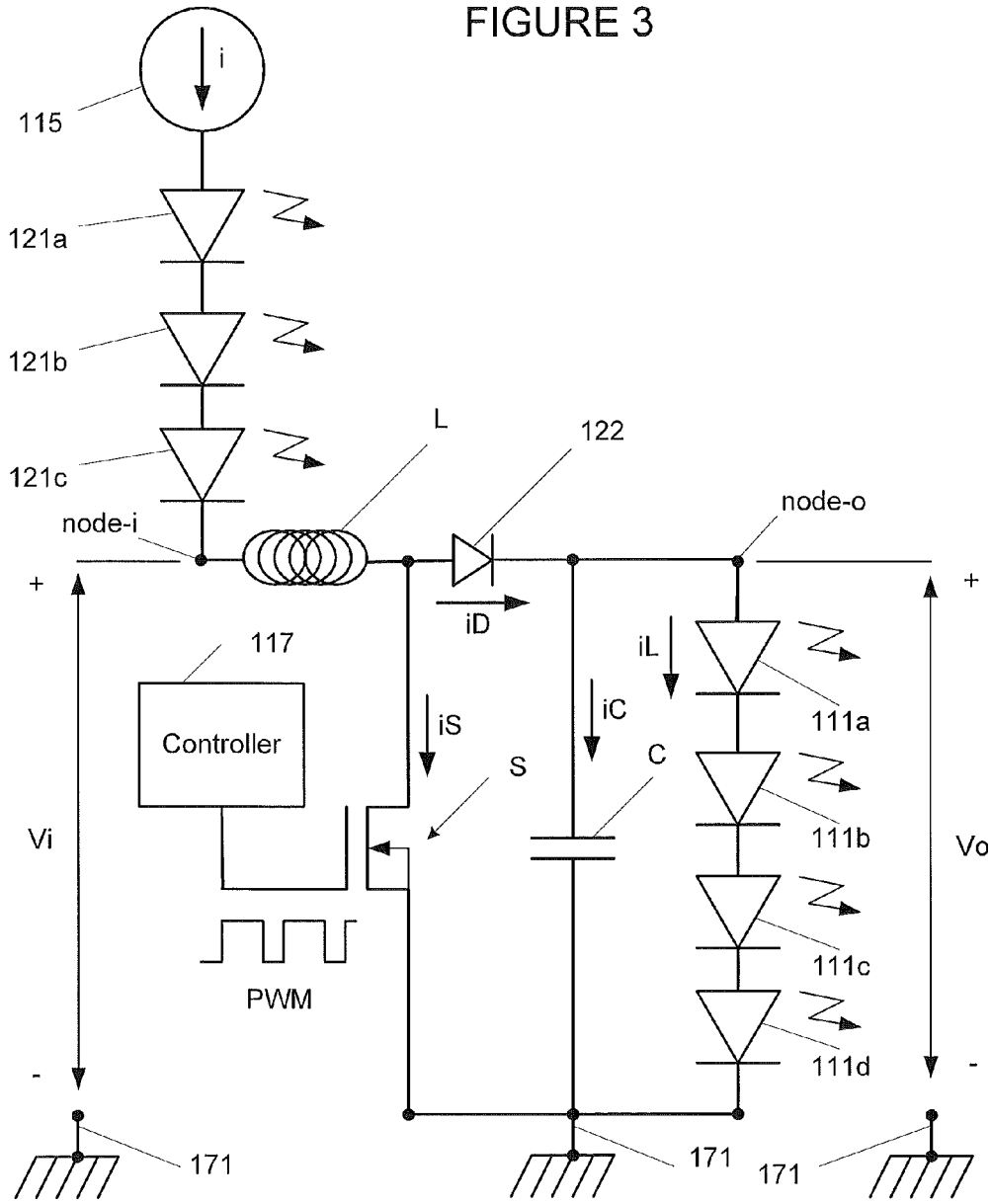

According to some embodiments of the present invention, a boost converter (including inductor L, diode 122, switch S, capacitor C, and controller 117) may be provided in solid state lighting device as shown in FIG. 3. In the structure of FIG. 3, relatively constant current i from current controlled power supply 115 (also referred to as a current controlled LED driver) that may be modeled as an ideal current source is provided through LEDs 121*a-c* and inductor L, a shunt current iS is provided through switch S at a duty cycle determined by a pulse width modulation (PWM) signal generated by controller 117, and a current iD (equal to the difference of minus iS) is provided through diode 122. Moreover, a current iC is provided thorough capacitor C, a current iL is provided through LEDs 111*a-d*, and iD is equal to the sum of iC and iL.

Un-shunted LEDs 121*a-c* may thus be electrically coupled in series between current controlled power supply 115 and input node node-i of the boost converter, and shunted LEDs 111*a-d* may be electrically coupled in series between output node node-o of the boost converter and reference node 171 such as a ground voltage node. According to some other embodiments, un-shunted LEDs 121*a-c* may be electrically coupled in series between reference node 171 (e.g., ground voltage node 171) and a second reference node (e.g., a negative voltage node) so that a current through un-shunted LEDs remains a sum of the currents iS and iD.

The boost converter of FIG. 3 is thus provided in series with current controlled power supply 115 (as opposed to a serial coupling with a voltage controlled power supply). Accordingly, the boost converter of FIG. 3 may be configured to adjust its input voltage Vi at input node node-i to correspond to a power provided to LEDs 111*a-d* (as opposed to controlling an output voltage). When operating in a steady state condition, a pulsed current iD through diode 122 may be conditioned using capacitor C and/or other elements to provide a relatively continuous current iL through LEDs 111*a-d*, and a relatively constant output voltage Vo may thus be maintained at output node node-o based on a sum of voltage drops across LEDs 111*a-d*. A power though LEDs 111*a-d* may thus be determined as a product of iL and Vo, and a non-pulsed current iL may be inversely related (e.g., inversely proportional) to a duty cycle of pulsed current iS when operating in a steady state condition.

By maintaining a continuous (e.g., non-pulsed) current iL through LEDs 111*a-d*, output voltage Vo may be regulated by LEDs 111*a-d*. Accordingly, a transfer function of the boost converter of FIG. 3 may be provided according to the following equations:

$$Vo/Vi=1/(1-D);$$

or $$Vi=Vo(1-D).$$

Moreover, an average of current iS through switch S is equal to a product of the current iL through LEDs 111*a-d* and the duty cycle D of current iS, as set forth below:

$$iS=(iL)D;$$

or $$iL=iS/D.$$

Output voltage Vo may thus be substantially constant as determined by a sum of voltage drops across LEDs 111*a-d* serially coupled between output node node-o and reference node 171 (e.g., ground voltage node), and input voltage Vi may be inversely related (e.g., proportional) to a duty cycle D of switch S. Substantially no power is consumed by current iS through switch S, and at any given duty cycle of current iS (in a steady state operating condition), input voltage Vi at node node-i may be substantially constant. Input voltage Vi at input node node-i may thus be substantially constant/stable even though shunt current iS through switch S is subjected to pulse width modulation.

By way of example, if current iS is switched through switch 131 at a 50% duty cycle (i.e., D=0.5), a relatively stable input voltage Vi may be maintained at input node node-i equal to about one half of the output voltage Vo, and power through LEDs 111*a-d* may be about one half of a maximum power (i.e., with IL=0.5i). If current iS is switched through switch 131 at a 25% duty cycle (i.e., D=0.25), a relatively stable input voltage Vi may be maintained at input node node-i equal to about three fourths of the output voltage Vo, and power through LEDs 111*a-d* may be about three fourths of a maximum power (i.e., with iL=0.75i). If current iS is switched through switch at a 0% duty cycle (i.e., D=0), a relatively stable input voltage Vi may be maintained at input node node-i equal to about the output voltage Vo, and power through LEDs 111*a-d* may be at a maximum power (i.e., with iL=i).

An inductance of inductor L and/or a capacitance of capacitor C may be varied according to a frequency of the pulse width modulation signal generated by controller 117 and applied to switch S. According to some embodiments, controller 117 may generate a pulse width modulation signal having a frequency of at least about 10 kHz (so that current iS is switched at a frequency of at least about 10 kHz), inductor L may have an inductance of at least about 10 μH, and capacitor C may have a capacitance of at least about 0.5 μF. According to further embodiments, controller 117 may generate a pulse width modulation signal having a frequency of at least about 40 kHz, and more particularly, at least about 60 kHz; inductor L may have an inductance of at least about 25 μH, and more particularly, at least about 33 μH; and capacitor C may have a capacitance of at least about 1.5 μF, and more particularly, at least about 2.2 μF.

Figure 4:
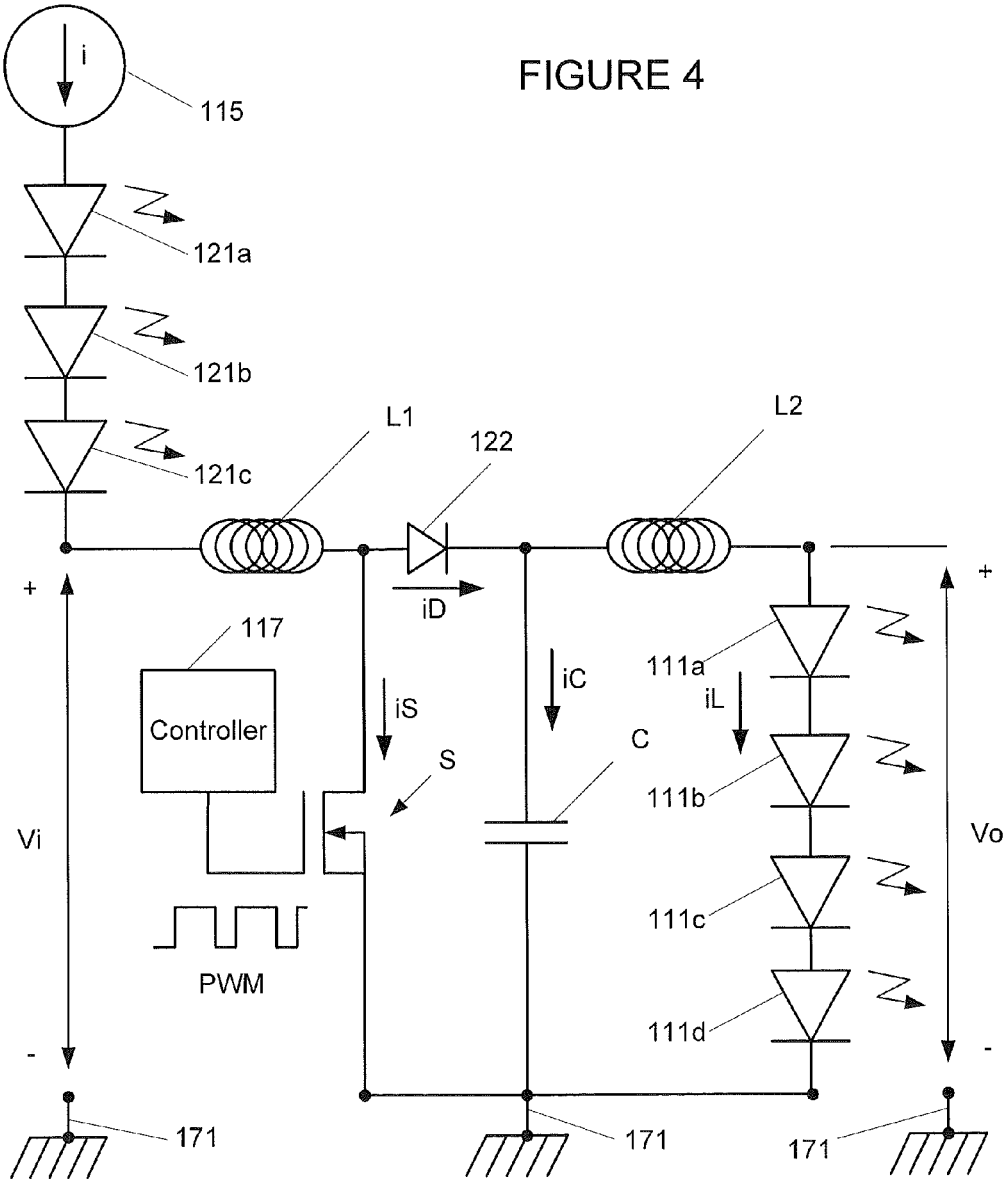
Figure 5:
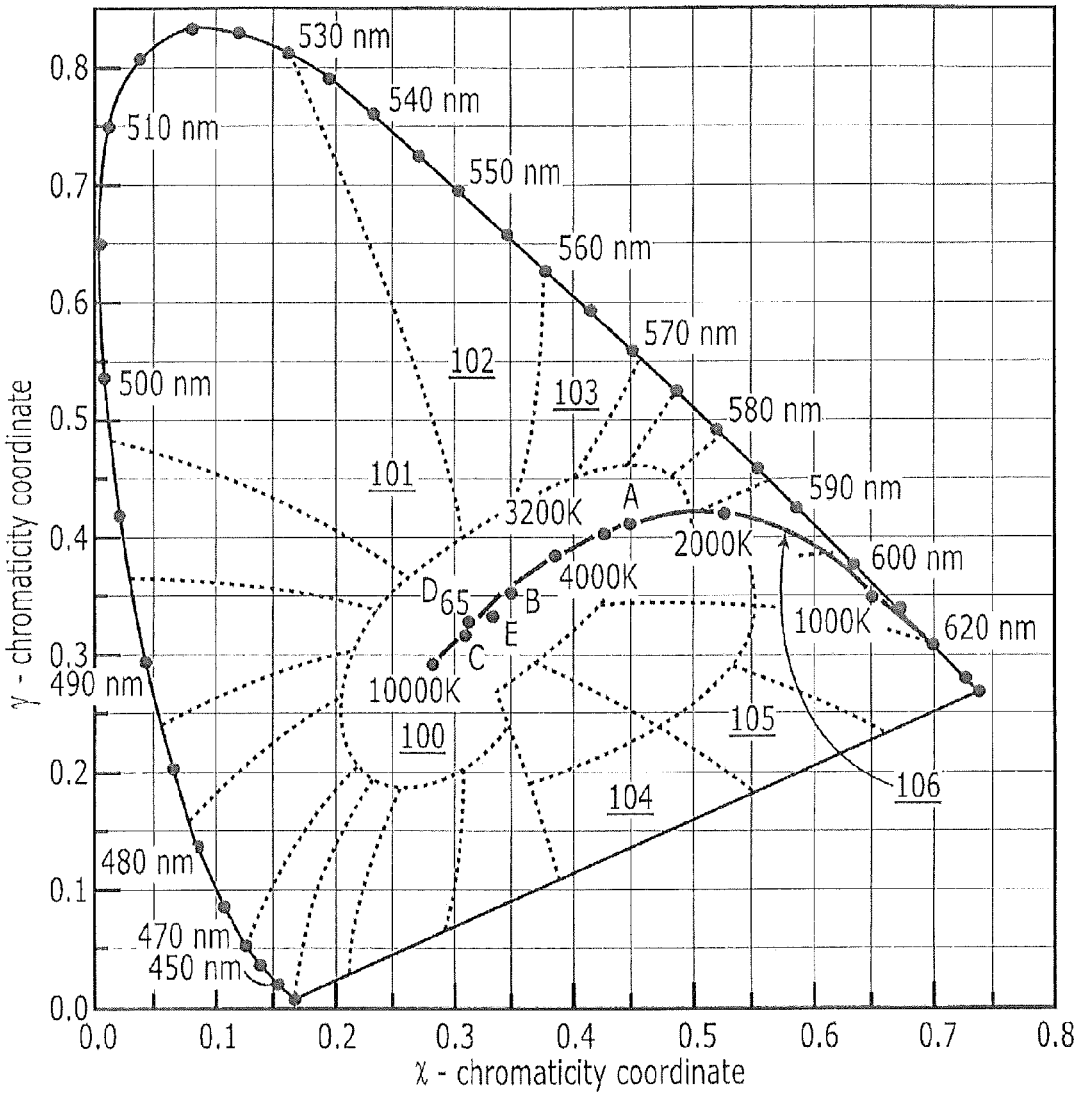
FIG. 5 illustrates a 1931 CIE chromaticity diagram.

According to some embodiments illustrated in FIG. 4, a second inductor L2 may be provided in series between LEDs 111*a-d* and diode 122 to reduce a ripple current through LEDs 111*a-d* and/or to reduce a size of first inductor L1. According to some embodiments, controller 117 of FIG. 4 may generate a pulse width modulation signal having a frequency of at least about 10 kHz (so that current iS is switched at a frequency of at least about 10 kHz), first and second inductors L1 and L2 may each have an inductance of at least about 10 μH, and capacitor C may have a capacitance of at least about 0.5 μF. According to some further embodiments, controller 117 may generate a pulse width modulation signal having a frequency of at least about 40 kHz, and more particularly, at least about 60 kHz; inductors L1 and L2 may each have an inductance of at least about 25 μH, and more particularly, at least about 33 μH; and capacitor C may have a capacitance of at least about 1.5 μF, and more particularly, at least about 2.2 μF.

Moreover, controller 117 may be implemented without a need for closed loop feedback. A relatively cheap microcontroller and/or other PWM generator may thus be used to precisely control switch S and current iS without corresponding power loss associated with attempting to maintain a full voltage of the shunted LEDs (i.e., LEDs 111*a-d*). The current iS shunted around LEDs 111*a-d* may be equal to a product of the current iL through the LEDs and the duty cycle of current iS.

Required PWM duty cycles for respective sets of conditions (e.g., target color point, temperature, current iL through LEDs 111*a-d*, current i through LEDs 121*a-c*, etc.) can be modeled using techniques similar to those described in U.S. application Ser. No. 12/987,485 (referenced above), and the duty cycles may be programmed in controller 117 for the modeled conditions. At a given set of conditions, controller 117 may generate a respective constant duty cycle PWM signal so that current iL (at steady state) through LEDs 111*a-d* is relatively constant, and so that input voltage Vi (at steady) is relatively constant. Controller 117, for example, may change a duty cycle of the PWM signal responsive to changes in temperature of LEDs 121*a-c* and/or 111*a-d* (using input from a temperature sensor), responsive to changes in current i generated by current controlled power supply 115, responsive to a dimmer input signal, etc.

Accordingly, controller 117 may be configured to provide a target color point and/or to provide lumen output control (e.g., dimmer control). If shunted LEDs 111*a-d* generate light having a first color (e.g., red) and un-shunted LEDs 121*a-c* generate light having a second color (e.g., BSY), a boost converter of FIGS. 3 and/or 4 may be configured to reduce the current iL through shunted LEDs 111*a-d* relative to the current i through un-shunted LEDs 121*a-c* to provide a desired color output for the lighting apparatus. Such control may be used to compensate for different characteristics (e.g., due to manufacturing variations) of different LEDs used in different devices and/or to compensate for different characteristics of transistors at different operating temperatures. If shunted LEDs 111*a-d* and un-shunted LEDs 121*a-c* generate light having a same/similar color/colors, controller 117 may be configured to provide lumen output control (e.g., dimmer control).

While three un-shunted LEDs 121*a-c* and four shunted LEDs 111*a-d* are shown in FIGS. 3 and 4 by way of example, other numbers of LEDs may be used. Moreover, relative placements of elements may be varied without changing the functionality thereof. As discussed above, un-shunted LEDs 121*a-c* may be provided between ground reference node 171 and a second reference node (e.g., a negative voltage node). Moreover, un-shunted LEDs may be provided between current controlled power supply 115 and input node node-i and between ground voltage node 171 and a negative voltage node. Moreover, inductor L2 may be provided between the shunted LEDs 111*a-d* and ground voltage node 171.

Embodiments of the present invention may thus provide systems and methods to control solid state lighting devices and lighting apparatus incorporating such systems and/or methods. Some embodiments of the present invention may be used in connection with and/or in place of bypass compensation circuits as described, for example, in co-pending and commonly assigned U.S. patent application Ser. No. 12/566,195 entitled "Solid State Lighting Apparatus with Controllable Bypass Circuits and Methods of Operating Thereof" published as U.S. Publication No. 2011/0068702 and co-pending and commonly assigned U.S. patent application Ser. No. 12/566,142 entitled "Solid State Lighting Apparatus with Configurable Shunts" published as U.S. Publication No. 2011/0068696. The disclosures both of the above referenced publications are incorporated herein by reference.

Boost converters discussed herein may variably shunt around LED(s) and/or bypass LED(s) in a solid state lighting device. According to some embodiments, an output of a solid state lighting device may be modeled based on one or more variables, such as current, temperature and/or LED bins (brightness and/or color bins) used, and the level of bypass/shunting employed, and this modeling may be used to program controller 117 on a device by device basis. The model may thus be adjusted for variations in individual solid state lighting devices.

According to embodiments of the present invention discussed above with respect to FIGS. 3 and 4, a boost converter may use a pulse width modulated shunt current iS (also referred to as a switched shunt current) to provide a substantially continuous electrical current iL through light emitting devices (LEDs) 111*a-d* while maintaining a substantially constant voltage at input node node-i when operating in a steady state condition. At a given duty cycle of pulse width modulated shunt current iS during steady state operation, for example, the boost converter may be configured to maintain a continuous current iL through LEDs 111*a-d* within 30% of an average of current iL and to maintain a constant input voltage Vi within 30% of an average of input voltage Vi. More particularly, the boost converter may be configured to maintain the continuous current iL through LEDs 111*a-d* within 15% or even 5% of the average of current iL and to maintain the constant input voltage Vi within 15% or even 5% of the average of input voltage Vi. Accordingly, a pulse width modulated shunt current iS may be used to control a substantially dc current iL through LEDs 111*a-d* while maintaining a substantially dc input voltage Vi at input node node-i. Improved power efficiency, reliability, and/or control may thus be achieved.

Controller 117 of FIGS. 3 and 4, for example, may generate a PWM control signal having any frequency greater than a flicker fusion threshold. According to some embodiments, controller 117 of FIGS. 3 and 4 may generate a PWM control signal having a frequency of at least about 1 kHz, at least about 10 kHz, at least about 30 kHz, or even at least about 50 kHz. Controller 117 of FIGS. 3 and 4, for example, may generate a PWM control signal having a frequency of about 60 kHz. By increasing the frequency of the PWM control signal of FIGS. 3 and 4, a size(s) of inductor(s) L, L1, and/or L2 may be reduced.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A device comprising:

a power supply;

a light emitting device; and a boost converter having an input node electrically coupled to the power supply and having an output node, with the light emitting device electrically coupled between the output node and a reference node, wherein the boost converter comprises, a switch electrically coupled in a current shunting path between the input node and the reference node, wherein the switch is configured to shunt current from the power supply around the light emitting device, and a controller configured to control a duty cycle of the switch to provide a pulse width modulated electrical current through the switch and a continuous electrical current through the light emitting device, wherein the controller is configured to control the duty cycle of the switch to provide the pulse width modulated electrical current as a pulsed current through the switch while providing the continuous electrical current through the light emitting device as a non-pulsed current through the light emitting device.

2. The device according to claim 1 wherein the switch is electrically coupled in the current shunting path between a switch node and the reference node, the boost converter further comprising, an inductor electrically coupled between the input node and the switch node, and a diode electrically coupled between the switch node and the output node.

3. The device according to claim 2 wherein the boost converter further comprises, a capacitor electrically coupled between a capacitor node at an output of the diode and the reference node.

4. The device according to claim 3 wherein the inductor comprises a first inductor, the boost converter further comprising, a second inductor electrically coupled between the capacitor node and the output node.

5. The device according to claim 1 wherein the boost converter is configured to provide a constant voltage at the input node corresponding to the continuous current through the light emitting device.

6. The device according to claim 1 wherein providing the continuous electrical current comprises maintaining the continuous electrical current within 30% of an average of the continuous electrical current responsive to the pulse width modulated electrical current through the switch.

7. A device comprising:

a power supply, wherein the power supply comprises a current controlled power supply;

a light emitting device; and a boost converter having an input node electrically coupled to the power supply and having an output node, with the light emitting device electrically coupled between the output node and a reference node, wherein the boost converter comprises, a switch electrically coupled in a current shunting path between the input node and the reference node, wherein the switch is configured to shunt current from the power supply around the light emitting device, and a controller configured to control a duty cycle of the switch to provide a pulse width modulated electrical current through the switch and a continuous electrical current through the light emitting device, wherein the controller is further configured to provide the pulse width modulated electrical current through the switch by providing a first pulse width modulated electrical current having a first duty cycle to provide a first continuous current through the light emitting device and a first constant voltage at the input node and by providing a second pulse width modulated electrical current having a second duty cycle to provide a second continuous current through the light emitting device and a second constant voltage at the input node, wherein the first duty cycle is greater than the second duty cycle, wherein the first continuous current is less than the second continuous current, and wherein the first constant voltage is less than the second constant voltage.

8. A device comprising:

a power supply;

a first light emitting device;

a boost converter having an input node electrically coupled to the power supply and having an output node, with the light emitting device electrically coupled between the output node and a reference node, wherein the reference node comprises a first reference node, wherein the boost converter comprises, a switch electrically coupled in a current shunting path between the input node and the reference node, wherein the switch is configured to shunt current from the power supply around the light emitting device, and a controller configured to control a duty cycle of the switch to provide a pulse width modulated electrical current through the switch and a continuous electrical current through the light emitting device; and a second light emitting device electrically coupled between the input node and the power supply and/or between the first reference node and a second reference node, so that a current through the second light emitting device is equal to a sum of the pulse width modulated electrical current through the switch and the continuous electrical current through the first light emitting device.

9. A device comprising:

a power supply;

a light emitting device; and a boost converter having an input node electrically coupled to the power supply and having an output node, with the light emitting device electrically coupled between the output node and a reference node, the boost converter comprising, a switch electrically coupled in a current shunting path between the input node and the reference node, a diode electrically coupled between the input node and the output node so that the diode is electrically coupled between the switch and the output node, and a controller electrically coupled to a control electrode of the switch, wherein the controller is configured to generate a pulse width modulation (PWM) signal to control a duty cycle of a pulse width modulated shunt current through the switch from the power supply away from the light emitting device, wherein the controller is configured to provide a first pulse width modulated shunt current having a first duty cycle to provide a first continuous current through the light emitting device and to provide a second pulse width modulated shunt current having a second duty cycle to provide a second continuous current through the light emitting device, wherein the first duty cycle is greater than the second duty cycle, and wherein the first continuous current is less than the second continuous current.

10. The device according to claim 9 wherein the switch is electrically coupled to a switch node between the input node and the diode, wherein the boost converter further comprises, an inductor electrically coupled between the input node and the switch node.

11. The device according to claim 10 wherein a capacitor node is defined between the diode and the output node, wherein the boost converter further comprises, a capacitor electrically coupled between the capacitor node and the reference node.

12. The device according to claim 11 wherein the inductor comprises a first inductor and wherein the boost converter further comprises, a second inductor electrically coupled between the capacitor node and the output node.

13. The device according to claim 9 wherein the light emitting device comprises a first light emitting device, and wherein the reference node comprises a first reference node, the solid state lighting device further comprising:

a second light emitting device electrically coupled between the input node and the power supply and/or between the first reference node and a second reference node, so that a current through the second light emitting device is equal to a sum of the pulse width modulated current through the switch and the continuous electrical current through the first light emitting device.

14. The device according to claim 9 wherein the boost converter is configured to provide a constant voltage at the input node corresponding to a continuous current provided through the light emitting device responsive to the pulse width modulated shunt current.

15. The device according to claim 9 wherein the power supply comprises a current controlled power supply, wherein the controller is configured to provide the first pulse width modulated shunt current having the first duty cycle to provide the first continuous current through the light emitting device and a first constant voltage at the input node and to provide the second pulse width modulated shunt current having the second duty cycle to provide the second continuous current through the light emitting device and a second constant voltage at the input node, and wherein the first constant voltage is less than the second constant voltage.

16. The device according to claim 9 wherein the controller is configured to control the duty cycle of the pulse width modulated shunt current through the switch to provide the first pulse width modulated shunt current as a first pulsed current through the switch while providing the first continuous electrical current through the light emitting device as a first non-pulsed current through the light emitting device, and to provide the second pulse width modulated shunt current as a second pulsed current through the switch while providing the second continuous electrical current through the light emitting device as a second non-pulsed current through the light emitting device.

17. The device according to claim 9 wherein providing the first continuous current comprises maintaining the first continuous current within 30% of an average of the first continuous current responsive to the first pulse width modulated shunt current through the switch, and wherein providing the second continuous current comprises maintaining the second continuous current within 30% of an average of the second continuous current responsive to the second pulse width modulated shunt current through the switch.

18. A device comprising:

a power supply;

a light emitting device; and a boost converter having an input node electrically coupled to the power supply and having an output node, with the light emitting device electrically coupled between the output node and a reference node, wherein the boost converter is configured to provide a continuous electrical current through the light emitting device and a constant voltage at the input node responsive to a pulse width modulated shunt current around the light emitting device, wherein the boost converter is configured to provide the pulse width modulated shunt current as a pulsed current around the light emitting device while providing the continuous electrical current through the light emitting device as a non-pulsed current through the light emitting device.

19. The device according to claim 18 wherein the power supply comprises a current controlled power supply.

20. The device according to claim 19 wherein the boost converter comprises, a switch electrically coupled in a current shunting path between the input node and the reference node, wherein the switch is configured to modulate the pulse width modulated shunt current through the current shunting path around the light emitting device, and a controller configured to generate a pulse width modulation (PWM) signal to control a duty cycle of the switch and a duty cycle of the pulse width modulated shunt current.

21. The device according to claim 20 wherein the switch is electrically coupled in the current shunting path between a switch node and the reference node, the boost converter further comprising, an inductor electrically coupled between the input node and the switch node, and a diode electrically coupled between the switch node and the output node.

22. The device according to claim 21 wherein the boost converter further comprises, a capacitor electrically coupled between a capacitor node at an output of the diode and the reference node.

23. The device according to claim 22 wherein the inductor comprises a first inductor, the boost converter further comprising, a second inductor electrically coupled between the capacitor node and the output node.

24. A device comprising:

a power supply;

a first light emitting device; and a boost converter having an input node electrically coupled to the power supply and having an output node, with the light emitting device electrically coupled between the output node and a first reference node, wherein the boost converter is configured to provide a continuous electrical current through the light emitting device and a constant voltage at the input node responsive to a pulse width modulated shunt current around the light emitting device; and a second light emitting device electrically coupled between the input node and the power supply, and/or between the first reference node and a second reference node, so that a current through the second light emitting device is equal to a sum of the continuous electrical current through the first light emitting device and the pulse width modulated shunt current around the first light emitting device.

25. A device comprising:

a power supply, a light emitting device; and a boost converter having an input node electrically coupled to the power supply and having an output node, with the light emitting device electrically coupled between the output node and a reference node, wherein the boost converter is configured to provide a continuous electrical current through the light emitting device and a constant voltage at the input node responsive to a pulse width modulated shunt current around the light emitting device, wherein the continuous electrical current comprises a first continuous electrical current, wherein the constant voltage comprises a first constant voltage, wherein the pulse width modulated shunt current comprises a first pulse width modulated shunt current having a first duty cycle, and wherein the boost converter is further configured to provide a second continuous electrical current through the light emitting device and a second constant voltage at the input node responsive to a second pulse width modulated shunt current having a second duty cycle, wherein the second continuous electrical current is greater than the first continuous electrical current, wherein the second constant voltage is greater than the first constant voltage, and wherein the second duty cycle is less than the first duty cycle.

26. A method of operating a solid state lighting device comprising a power supply and a light emitting device, the method comprising:

providing a continuous electrical current through the light emitting device and a constant voltage at an input node between the light emitting device and the power supply responsive to a pulse width modulated shunt current around the light emitting device, wherein providing the continuous electrical current comprises providing the continuous electrical current as a non-pulsed current through the light emitting device while providing the pulse width modulated shunt current as a pulsed current around the light emitting device.

27. The method according to claim 26 wherein the power supply comprises a current controlled power supply.

28. The method according to claim 26 wherein providing the continuous electrical current and the constant voltage comprises maintaining the continuous electrical current within 30% of an average of the continuous electrical current responsive to the pulse width modulated shunt current.

29. The method according to claim 28 wherein providing the continuous electrical current and the constant voltage comprises maintaining the constant voltage within 30% of an average of the constant voltage responsive to the pulse width modulated shunt current.

30. A method of operating a solid state lighting device comprising a power supply and a light emitting device, wherein the power supply comprises a current controlled power supply, the method comprising:

providing a continuous electrical current through the light emitting device and a constant voltage at an input node between the light emitting device and the power supply responsive to a pulse width modulated shunt current around the light emitting device, wherein the light emitting device comprises a first light emitting device electrically coupled between the input node and a first reference node, wherein the solid state lighting device further comprises a second light emitting device electrically coupled between the input node and the power supply and/or between the first reference node and a second reference node, so that a current through the second light emitting device is equal to a sum of the continuous electrical current through the first light emitting device and the pulse width modulated shunt current around the first light emitting device.

31. A method of operating a solid state lighting device comprising a power supply and a light emitting device, the method comprising:

providing a continuous electrical current through the light emitting device and a constant voltage at an input node between the light emitting device and the power supply responsive to a pulse width modulated shunt current around the light emitting device, wherein the continuous electrical current comprises a first continuous electrical current, wherein the constant voltage comprises a first constant voltage, and wherein the pulse width modulated shunt current comprises a first pulse width modulated shunt current having a first duty cycle; and providing a second continuous electrical current through the light emitting device and a second constant voltage at the input node responsive to a second pulse width modulated shunt current having a second duty cycle, wherein the second continuous electrical current is greater than the first continuous electrical current, wherein the second constant voltage is greater than the first constant voltage, and wherein the second duty cycle is less than the first duty cycle.

32. A device comprising:

a power supply, a light emitting device; and a boost converter having an input node electrically coupled to the power supply and having an output node, with the light emitting device electrically coupled between the output node and a reference node, wherein the boost converter comprises, a switch electrically coupled in a current shunting path between the input node and the reference node, wherein the switch is configured to shunt current from the power supply around the light emitting device, and a controller configured to control a duty cycle of the switch to provide a pulse width modulated electrical current through the switch and a continuous electrical current through the light emitting device, wherein the controller is further configured to provide the pulse width modulated electrical current through the switch by providing a first pulse width modulated electrical current having a first duty cycle to provide a first continuous current through the light emitting device and a first voltage at the input node and by providing a second pulse width modulated electrical current having a second duty cycle to provide a second continuous current through the light emitting device and a second voltage at the input node, wherein the first duty cycle is greater than the second duty cycle, wherein the first continuous current is less than the second continuous current, and wherein the first voltage is less than the second voltage.

33. A device comprising:

a power supply;

a light emitting device; and a boost converter having an input node electrically coupled to the power supply and having an output node, with the light emitting device electrically coupled between the output node and a reference node, wherein the boost converter is configured to provide a continuous electrical current through the light emitting device and a constant voltage at the input node responsive to a pulse width modulated shunt current around the light emitting device, and wherein the boost converter is configured to maintain the continuous electrical current within 30% of an average of the continuous electrical current and to maintain the constant voltage within 30% of an average of the constant voltage responsive to the pulse width modulated shunt current.

* * * * *